United States Patent [19]

Chiappetti

[11] 4,338,587

[45] Jul. 6, 1982

[54] TOLL COLLECTION SYSTEM

[76] Inventor: Arthur B. Chiappetti, 10600 S. Oakley, Chicago, Ill. 60643

[21] Appl. No.: 177,036

[22] Filed: Aug. 11, 1980

Related U.S. Application Data

[63] Continuation-in-part of Ser. No. 14,448, Feb. 23, 1979, abandoned.

[51] Int. Cl.[3] ..... G08G 1/01

[52] U.S. Cl. ..... 340/32; 340/22; 340/505; 340/539

[58] Field of Search ..... 340/22, 23, 31 R, 32, 340/38 R, 505, 539

[56] References Cited

U.S. PATENT DOCUMENTS 3,644,883 2/1972 Borman et al. ..... 340/23

4,182,989 1/1980 Endo et al. ..... 340/23

*Primary Examiner*—Alvin H. Waring

*Attorney, Agent, or Firm*—Bernard L. Kleinke

[57] ABSTRACT

A vehicle toll collection system automatically identifies vehicles traveling along a vehicle lane. The system includes a mobile vehicle identification sending unit adapted to be mounted on at least one of the vehicles for sending vehicle identification information. A stationary control unit is disposed near the vehicle lane for receiving the identification information from the mobile unit as the vehicle moves past the stationary unit to register the vehicle identity. The stationary unit includes devices which respond to the vehicle identification information for generating a vehicle signal indicating that a vehicle has been registered.

16 Claims, 4 Drawing Figures

TOLL COLLECTION SYSTEM

CROSS REFERENCE TO RELATED APPLICATION

This application is a continuation-in-part of application Ser. No. 14,448, filed Feb. 23, 1979 entitled "Toll Collection System", now abandoned.

BACKGROUND OF THE INVENTION

The present invention relates in general to a vehicle toll collection system, and it more particularly relates to such a vehicle toll collection system, which enables a vehicle to be charged a toll without requiring that the vehicle come to a complete stop and deposit money.

Toll roads have become very popular, because they offer a convenient and equitable scheme for financing the construction of roadways. In this regard, drivers of vehicles using the roadway pay a small sum of money as a toll, and the toll has been collected at various different stations along the roadway. These stations have included toll booth and automatic collection devices, whereby a vehicle must come to a complete stop adjacent the station and pay the toll by depositing currency with the toll booth operator or in the automatic collection device. Once the toll has been paid, a light or gate or other such warning device indicates to the driver of the vehicle that the correct amount has been paid and the vehicle is free to proceed on down the tollway. While such toll collection systems have been satisfactory for some applications, it would be highly desirable to have a toll collection system which is faster and more efficient. In this regard, with present toll collection techniques, long lines of vehicles have caused unwanted and undesirable delays at the toll stations since the vehicles are required to come to a complete stop at the toll station to pay the toll and are then required to wait until the permission is granted to proceed on further. With more and more vehicles in use at the present time, the lines are becoming longer and the problem is becoming acute. Such present day toll collection techniques are particularly troublesome to truck drivers, since they are required to maintain shipping schedules. Perhaps the most serious problem associated with present day inefficient toll collection techniques is the waste of valuable fuel energy during the long delays encountered at the toll station. When automobiles, trucks and other vehicles are forced to wait in line at the toll stations, huge quantities of fuel are wasted each year. Therefore it would be highly desirable to eliminate these unwanted and unnecessary delays associated with the collection of tolls for the conservation of energy as well as providing for a more efficient toll collection arrangement.

Therefore, the principal object of the present invention is to provide a new and improved toll collection system, which greatly facilitates the collection of vehicle tolls along a tollway.

Briefly, the above and further objects of the present invention are realized by providing a vehicle toll collection system which includes at least one elongated vehicle lane indicia for indicating a predetermined path of travel for the vehicles therealong over a roadway, and a plurality of mobile vehicle identification sending units adapted to be mounted on the vehicles for sending vehicle identification information. A stationary control unit is disposed near the entrance to the lane indicia for receiving the identification information from vehicles equipped with the mobile units as the vehicles move past to register their identification for toll collection purposes. A vehicle detection device is disposed at the lane indicia for supplying a vehicle present signal to the stationary control unit. The stationary control unit is responsive to the vehicle present signal and a vehicle failing to send its vehicle identification information for generating a vehicle warning signal. A warning device is disposed near the vehicle lane indicia and is responsive to the warning signal for indicating that a vehicle has not been registered. Thus, as equipped vehicles drive past the stationary control unit, vehicle identification information is registered therein so that the owners of such vehicles can be charged for the tolls by the toll authority without requiring the vehicles to stop and pay the toll, thereby eliminating or at least decreasing greatly the unnecessary and unwanted delays. Should a vehicle not be equipped with a mobile unit or the unit is defective or otherwise not functioning properly, the warning device is energized to cause the vehicle to stop and pay the toll in a conventional manner.

BRIEF DESCRIPTION OF THE DRAWINGS

The above-mentioned and other objects and features of this invention and the manner of attaining them will become apparent, and the invention itself will be best understood by reference to the following description of an embodiment of the invention taken in conjunction with the accompanying drawings wherein.

DETAILED DESCRIPTION

Figure 1:
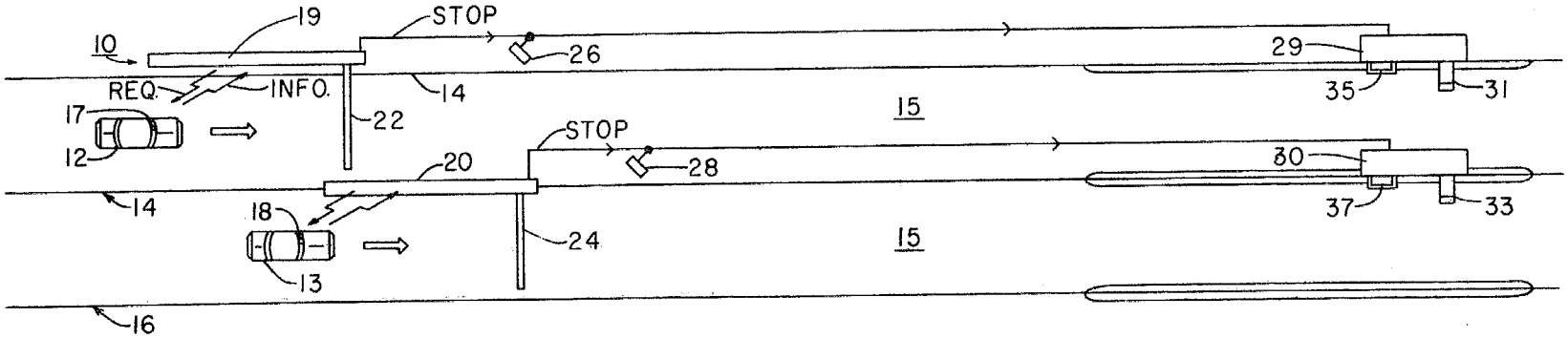
FIG. 1 is a partly schematic plan view of the vehicle toll collection system, which is constructed in accordance with the present invention.

Referring now to FIG. 1 of the drawings, there is shown a vehicle toll collection system 10, which is constructed in accordance with the present invention and which is adapted to be used for the collection of tolls based on the use of the vehicles, such as the automobiles 12 and 13 of the toll road 15, the tolls being charged as the vehicles are driven along a series of toll collection lanes delineated by elongated vehicle lane indicia or markings 14 and 16 extending side by side along the tollway 15. It is to be understood that the lanes identified by the indicia 14 and 16 may be considered "express" lanes and other conventional toll collection lanes may also be used in combination with the express lanes.

The toll collection system 10 generally comprises a mobile vehicle sending unit 17 mounted within the automobile 12, the automobile 13 also being equipped with a similar mobile vehicle radio sending unit 18. Each one of the mobile sending units is adapted to send unique vehicle identification information, such as the signal INFO concerning the vehicle 12 as hereinafter described in greater detail. A stationary control unit 19 is disposed near the entrance of the inner lane indicia 14 for generating a signal REQ to request the mobile unit 17 to send its signal INFO, and for receiving the vehicle identification information signal INFO from the mobile unit 17 as the automobile 12 moves past the stationary control unit 19 to record the vehicle identification information for the automobile 12 for toll collection purposes. A similar stationary control unit 20 is mounted near the entrance in the adjacent lane delineated by the lane indicia 16 for receiving the vehicle identification information from the mobile unit 18 mounted in the automobile 13 as it travels past the stationary unit 20. The vehicle identification information signal INFO is sufficient information to identify the vehicle sending it, and may be the vehicle license plate information, such as the state and license number.

A plurality of vehicle detection devices, such as the cable switches 22 and 24 extend from the respective stationary units 18 and 20 across their respective lanes resting on the tollway 15 and are disposed at the trailing end of their respective stationary control units for supplying a vehicle present signal to their respective control units. As hereinafter described in greater detail, the control units respond to its vehicle present signal and vehicles failing to send their vehicle identification information for generating signals designated as STOP, which are transmitted to a pair of respective stop signs 26 and 28 and to a pair of respective operator manned toll booths 29 and 30, respectively, to operate a pair of respective warning devices (not shown) thereat. Each one of the stop signs, when energized by its stop signal, displays the message "STOP PAY TOLL" to alert the driver of the vehicle that the vehicle identification information was not properly recorded. The toll booth warning devices provide the same indication to the toll booth operator, who is then alerted to take down the license number information from the vehicle in question for toll charging purposes so that the vehicle need not come to a stop. In this regard, the toll booth operator can signal the driver to continue on without stopping and thus without delaying the line of vehicles waiting in that lane.

If the operator, for any reason, is unable to observe the license plates of the vehicle in question, a pair of gates 31 and 33 at the respective booths 29 and 30 may be lowered by the operators for indicating that a vehicle has not been registered and must stop to deposit the necessary toll money into a pair of collection baskets 35 and 37 associated with the toll booths 29 and 30, respectively, or alternatively, to provide the operator with the necessary license plate information. Once the proper coins are deposited in the respective coin collection baskets or the necessary information supplied, the gate is raised to permit the vehicle to pass thereby and continue on down the tollway.

Thus, it should be understood that the automobiles need not come to a complete stop for toll collection purposes, and thus unnecessary and unwarranted delays are alleviated. Also, conventional toll booth coin collection devices and warning devices, such as gates or lights, may be employed so that existing equipment can continue to be utilized while permitting the collection of tolls on an express basis.

Figure 2:
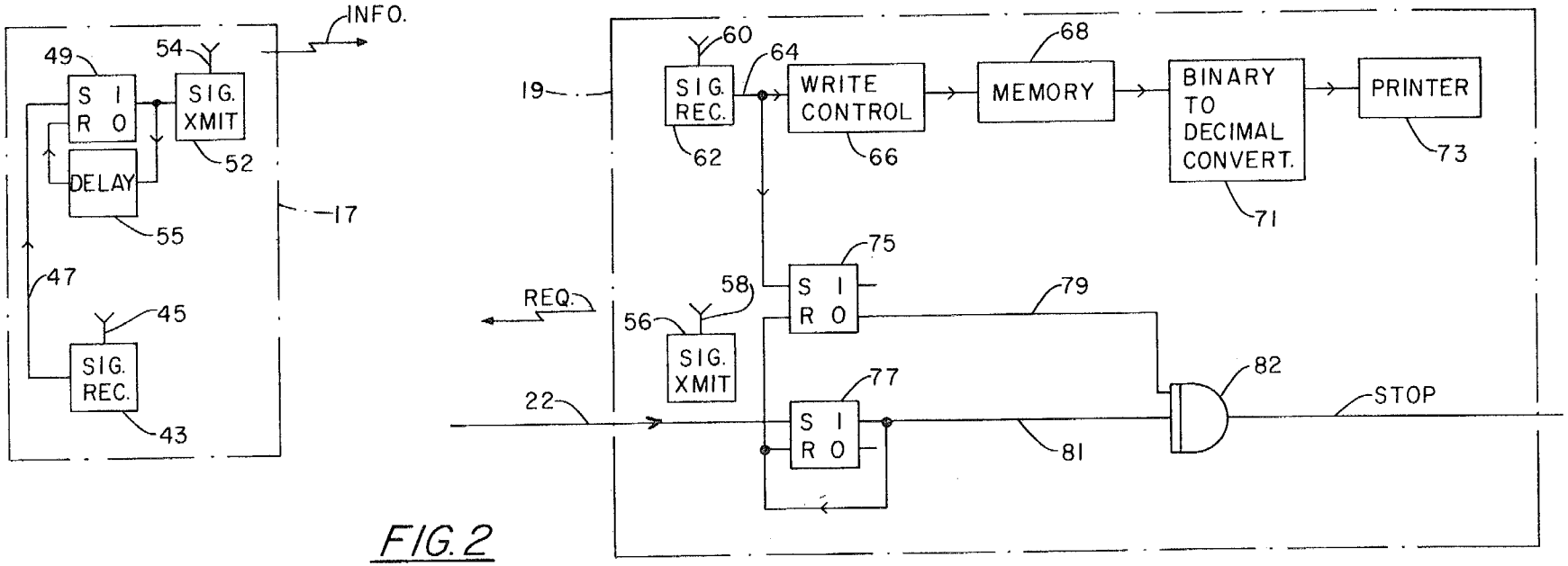
FIG. 2 is a symbolic block diagram view of the mobile and stationary units of the system of FIG. 1.

Considering now the mobile unit 17 in greater detail with reference to FIG. 2 of the drawings, the unit 18 being similar to it and thus not needing further description, the mobile unit 17 is battery powered and mounted within the vehicle 12. The unit 17 includes a radio signal receiver 43 having an antenna 45 for receiving the signal REQ from the stationary unit 19 to turn on the mobile unit 17. The output of the signal receiver 43 is connected via a lead 47 to the SET input of a bi-stable device 49, such as a flip-flop, to set it. In this regard, the signal receiver 43 is turned on by the signal REQ to in turn set the bi-stable device 49. A signal generator 52 is a signal coded generator radio transmitter for transmitting the signal INFO from its antenna 54 in response to the one output of the bi-stable device 49. A delay device 55 has its input connected to the one output of the bi-stable device 49 and has its output connected to the reset input to the bi-stable device 49 to reset it once the device 49 has been set after a given time delay interval determined by the delay device 55. In this regard, the bi-stable device 49 remains set for the time interval determined by the delay device 55 so that the signal generator 52 remains on for a sufficiently long period of time to generate the signal INFO.

Considering now the stationary unit in greater detail, stationary unit 18 will now be described in greater detail, it being understood that the stationary unit 20 is similar to it and need not be described in further detail. The unit 18 includes a signal generator radio transmitter 56 having an antenna 58 for generating the signal REQ. The transmitter 56 is continuously and repeatedly generating the signal REQ which is a pulse signal for turning on mobile units in vehicles passing thereby. An antenna 60 of a radio signal receiver 62 is adapted to receive the signal INFO from the mobile unit 16 as well as any other similar mobile unit in vehicles passing thereby. The signal receiver 62 is a radio receiver which is tuned to the same channel as the signal generator 52. The signal transmitters 43 and 56 are low power transmitters, since they operate only when the mobile and stationary units are in relatively close proximity to one another so as not to interfere with the operation of mobile and stationary units in adjacent express lanes. In order to help further isolate the transmissions taking place in adjacent or nearby express lanes, the stationary control units 19 and 20 are staggered longitudinally relative to one another.

An output 64 of the receiver 62 is connected to the input of a write control circuit 66, which in turn has its output connected to a memory 68 for storing the signal information to register the vehicle identification of the vehicles passing thereby. A binary-to-decimal converter 71 translates the output of the memory 68 to a decimal form of information and supplies it to a printer 73, whereby the printed records are provided.

A bi-stable device 75 in the form of a flip-flop has its SET input connected to the output 64 of the receiver 62 to be set when the signal INFO is received. A bi-stable device 77 has its SET input connected to the cable switch 22 to set it when the vehicle 12 rolls over the cable switch 22, thereby detecting the presence of the vehicle passing by the stationary control unit 18. The one outputs of the bi-stable devices 75 and 77 are connected via the respective leads 79 and 81 to the inputs of a coincidence AND gate 82 so that, when the gate 82 is enabled, it generates the signal STOP for causing the sign 26 to display its message and the warning device in the booth 29 to be activated. Thus, the gate 82 is enabled when the bi-stable device 75 remains reset due to the absence of registration of vehicle identification information in the stationary control unit 18 and coincidentally the setting of the bi-stable device 77 in response to the actuation of the cable switch 22 by a vehicle indicating the presence thereof. Thus, the signal STOP is generated when a vehicle passes by the control unit 18 without registering its vehicle identification information therewith.

The signal INFO identifies the vehicle equipped with the mobile unit 16 and can include such information as the vehicle identification or license plate number, the state of registration of the vehicle, and a request for a receipt to be sent to the owner of the vehicle. In order to collect the tolls from the vehicle owners, at the time the state license plates are purchased, an additional estimated flat fee is charged in advance for payment of the tolls for the next year. At the end of the year, the vehicle owner receives a written receipt for the actual charges made against his account. At the beginning of the next year, when the license plates are ordered, the tolls that were actually used may be either credited or debited against the applicant's account so that an adequate adjustment can be made to the surcharge for the tolls. The state of registration is responsible for the collection and administration of the tolls so that the vehicle owner can be credited for the actual usage of the tollway systems.

Figure 4:
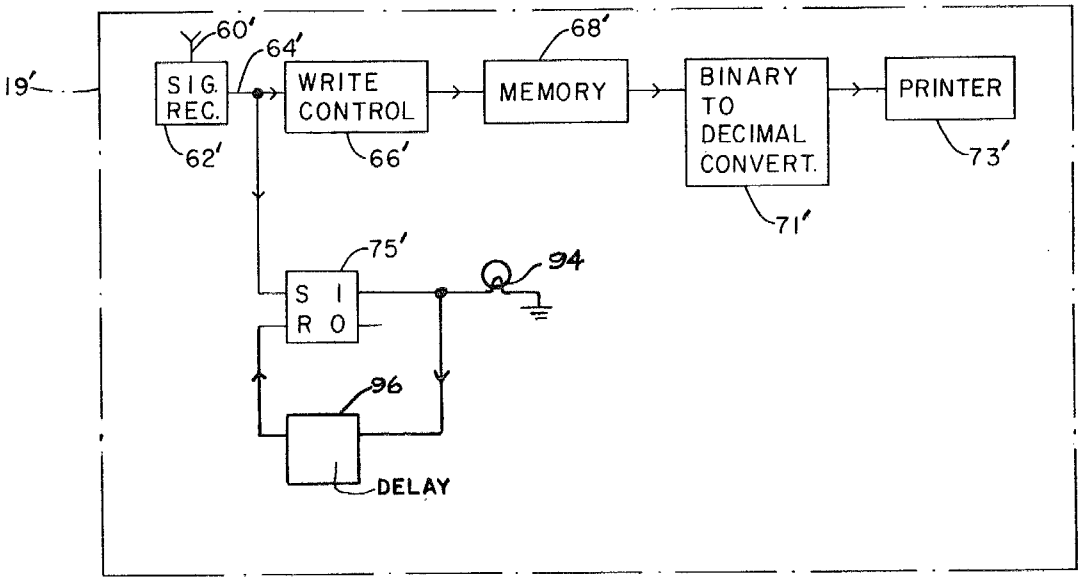
FIG. 4 is a symbolic block diagram of the mobile and stationary units of the system of FIG. 3.
Figure 3:
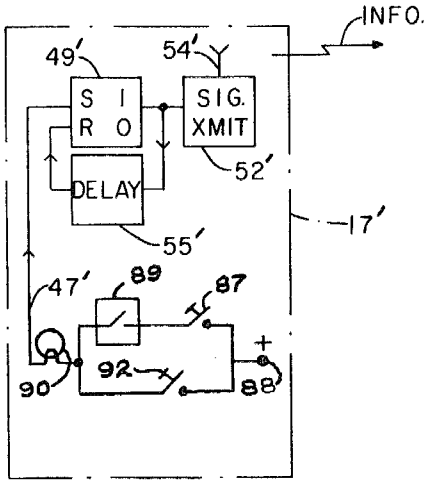
FIG. 3 is a pictorial view of another system constructed according to the invention.
Figure 3:
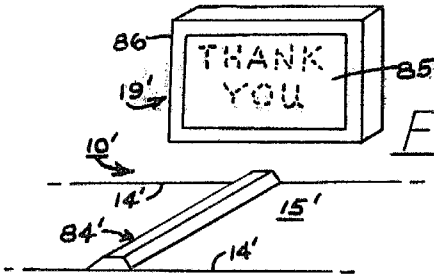

Referring now to FIGS. 3 and 4 of the drawings, there is shown another vehicle collection system 10', which is constructed in accordance with the present invention. The system 10' is generally similar to the system 10 except that the generation of a request signal REQ by the stationary unit and the vehicle detection devices (cable switches 22 and 24), have been eliminated.

The parts of the system 10' corresponding to and being similar to the parts of the system 10, are designated by the same reference character followed by a prime notation (') as a super script. Such corresponding similar parts so designated will not be described.

The system 10' is adapted to be used for the collection of tolls based on the use of the vehicles (not shown) of the tollway 15'. The tolls are charged as the vehicles are driven, without stopping, along an express toll lane delineated by elongated vehicle lane indicia or markings 14' extending in a parallel spaced-apart manner along the tollway 15'. The vehicles may be required to be driven at or below a certain speed, but they are not required to come to a complete stop.

The system 10' generally comprises a mobile vehicle sending unit 17' mounted within a vehicle, other vehicles being equipped with similar such sending units. Each one of the mobile sending units is adapted to send unique vehicle identification information, such as the signal INFO to identify its vehicle in a similar manner as the sending unit 17.

A stationary control unit 19' is disposed on the ground adjacent the lane indicia 14' out of lanes of traffic. An elongated abutment 84 extends across the express lane near the stationary unit 19' to cause the vehicles to ride up and over the abutment to cause automatically the sending unit 17' to transmit the vehicle identification signal INFO to the stationary unit 19' as hereinafter described in greater detail.

When the signal INFO is received, an annunciator panel 85 on the front of the housing 86 facing the passing vehicles for the stationary unit 19' indicates that the vehicle's identity has been registered and that the toll has thus been charged. In so doing, a message, such as "THANK YOU," may be illuminated to notify the driver of the vehicle that the toll has been charged, and thus the vehicle is free to proceed further. Other indications, such as audible signals, may also be generated as a further indication to the drivers of vehicles passing by the unit 19'.

Therefore, in operation, a series of vehicles equipped with sending units, similar to the unit 17', can drive along the express lane and as they ride up and over the abutment 84, their sending units are turned on automatically to transmit their unique vehicle identity signal INFO for registration in the stationary unit 19'. Each time the signal INFO is received from a passing vehicle, the annunicator panel 85 illuminates the message "THANK YOU" for a short interval of time, such as about one to three seconds. Thus, an attendant positioned near the stationary unit 19' could notice the annunciator panel 85 becoming energized each time a vehicle passes by the stationary unit 19'.

If a vehicle was not equipped with a sending unit, or if a sending unit failed to operate due to a malfunction, the annunciator panel 85 would not respond to so indicate to the attendant. The attendant could then record the identity of the vehicle by writing down the license plate information or could otherwise signal the vehicle to come to a complete stop for paying the toll before proceeding further. If desired, gates, such as the gates 31 and 33 of FIG. 1 may also be provided.

Considering now the mobile unit 17' in greater detail with reference to FIG. 4 of the drawings, the unit 17' is battery powered, or it can be powered electrically by the vehicle electrical system (not shown). The unit 17' is mounted fixedly under the vehicle dashboard (not shown) or other convenient location on the vehicle.

In order to turn on a bi-stable device 49' and thus a signal coded radio transmitter signal generator 52' for generating the signal INFO from an antenna 54' for a length of time determined by a delay device 55', a manual normally-open ON-OFF power switch 87 is closed manually by the driver of the vehicle prior to approaching the stationary unit 19' to connect a source of power 88 through the switch 87, a normally-open vehicle condition sensing switch in the form of a shaker switch 89, a light bulb 90, and a lead 47' to the set input for the bi-stable device 49'. A sign (not shown) can be provided along the side of the tollway to alert the driver to prepare for charging the toll by closing the ON-OFF switch 87. Once the vehicle rides up and over the abutment 84, which may be in the form of a "speed breaker" concrete block fixed to the roadway, the vehicle is jarred to close the shaker switch 89. Closing of the switch 89 completes the path from the source of power 88 through the closed switch 87, the closed switch 89, and the light bulb 90 to supply a signal via the lead 47' to the set input of the device 49'. The device 49' then becomes set and causes the signal transmitter generator 52' to generate the signal INFO from the antenna 54'.

The receipt of the signal INFO by an antenna 60' of a signal receiver 62' of the stationary unit 19' causes the annunciator panel 85 to be illuminated. Also, the illumination of the light bulb 90 of the sending unit 17' serves as a visual indication to the attendant that the signal INFO has been transmitted. Thus, the attendant can notice the illumination of the light bulb 90 through the vehicle windows (not shown), and/or an attention-attracting audible signal generator (not shown) can be energized in a similar manner as the light bulb 90, to provide a similar indication from the passing vehicle to the attendant.

A manual normally-open switch 92 is connected between the source of power 88 and the light bulb 90 in parallel with the serially connected switches 87 and 89 to enable the driver of the vehicle to turn on the sending unit 17' and transmit the signal INFO without the necessity of closing either one of the switches 87 or 89. The driver can close the switch 92, when the vehicle travels opposite the stationary unit 19' to transmit the signal INFO. Thus, the sending unit 17' can be triggered manually where there is no abutment 84, or where either one of the switches 87 or 89 malfunctions.

The shaker switch 89 is an electrical switch, which closes when it is vibrated mechanically or otherwise bounced or jarred. The closing of the switch 89 can be adjusted mechanically by means of a sensitivity control (not shown) so that ordinary road vibrations do not cause the closing of the switch 89 but the substantial jarring produced by the abutment 84 does cause the closing of the switch 89. Once such a sufficient vibration caused by the vehicle wheels (not shown) moving abruptly into engagement with the abutment 84 to jar the vehicle and thus the switch 89, the closing of the switch 89 may only be momentary, but such a momentary closing is sufficiently long to cause the setting of the bi-stable device 49'.

The shaker switch 89 may be of the type manufactured by Universal Security Instruments, Inc., 10324 S. Dolfield Rd., Owings Mills, Md., 21117.

It will become apparent to those skilled in the art that the vehicle condition sensing switch 89 may also be in the form of a gravity actuated switch, which closes when it tilts as the front end portion of the vehicle lifts upwardly as it moves up and over the abutment 84. The gravity actuated switch may be a mercury switch manufactured by the aforementioned Universal Security Instruments, Inc.

As shown in FIG. 3, the abutment 84 is in the form of an elongated heavy block composed of a hard durable material, such as concrete, to absorb the impacts from the vehicles. The cross-section of the abutment 84 is four sided having flat upper and lower sides and inclined converging front and rear sides. By suitable means (not shown), the abutment 84 is anchored securely to the ground.

Considering now the stationary unit 19' in greater detail with reference to FIG. 4 of the drawings, a bi-stable device 75' is set in response to the output of a signal receiver 62' receiving via an antenna 60' the signal INFO, and in turn, energizes a light bulb 94. The light bulb 94 is disposed behind the annunciator panel 85 to illuminate it. The one output of the bi-stable device 75' is also coupled through a delay device 96 to the reset input of the bi-stable device 75' to maintain it on for a predetermined time before resetting the device 75' to extinguish the light bulb 94.

While particular embodiments of the present invention have been disclosed, it is to be understood that various different modifications are possible and are contemplated within the true spirit and scope of the appended claims. For example, in place of the cable switches, photoelectric sensing devices may be employed. Also, while the systems and apparatus and devices therefor have been shown and described for use with charging tolls along a tollroad, it will become apparent to those skilled in the art that they may also be used, in general, for automatic vehicle identification purposes for tunnels, bridges, parking lots, railroad cars, ships and the like. There is no intention, therefore, of limitations to the exact abstract or disclosure herein presented.

The embodiments of the invention in which an exclusive property or privilege is claimed are defined as follows:

1. In a vehicle toll collection system for vehicles, the system including at least one elongated vehicle lane indicia means for directing the vehicles therealong over a roadway, a stationary control unit comprising:

said stationary control unit being disposed at said indicia means having receiving means adapted to receive a series of vehicle identification information signals from each one of a series of the vehicles traveling therepast along the roadway, said signals being coded to identify uniquely the vehicle sending it;

a signal transmitter for generating and sending request signals to the vehicles passing by the stationary control unit to cause the vehicles to return their vehicle identification signals to said stationary control unit;

memory means responsive to said receiving means receiving identification information signals from passing vehicles for storing the identification information signals; and logic means responsive to said receiving means receiving all of the identification information signals from each one of the passing vehicles for generating vehicle warning signals corresponding to each one of the passing vehicles and indicative of whether or not identification information signals were properly received.

2. In a vehicle toll collection system, a stationary control unit according to claim 1, further including a signal transmitter for generating and sending a request signal to vehicles passing by the stationary control unit, said mobile unit having a signal receiver for receiving the request signal for activating the mobile unit to generate the vehicle information signal.

3. In a vehicle toll collection system, a stationary control unit according to claim 1, wherein said mobile unit includes a bi-stable device adapted to be enabled for initiating the sending of the vehicle information signal, a signal generator having its input connected to the output of the bi-stable device generating said vehicle information signal.

4. In a vehicle toll collection system, a stationary control unit according to claim 1, further including bi-stable means adapted to be set in response to the receipt of the information signals and second bi-stable means for being set in response to said vehicles being present.

5. In a vehicle toll collection system, a stationary control unit according to claim 4, further including a coincidence AND gate for responding to said first bi-stable means being reset and said second bi-stable means being set for generating a stop signal indicating that a vehicle has failed to register its identity.

6. In a vehicle toll collection system, a stationary control unit according to claim 5, further including a write control device which responds to a signal receiver for receiving the information signal, said memory means for storing the information received by the receiver and transferred to it via said write control device, a binary-to-decimal converter for transferring the information stored in the memory to a printer.

7. In a vehicle toll collection system, a stationary control unit according to claim 1, wherein said logic means includes vehicle detection means for supplying a vehicle present signal, means responsive to said vehicle present signal and a vehicle failing to send its vehicle identification information for generating said vehicle warning signal, warning means activated by said warning signal for indicating that a vehicle has not been registered.

8. In a vehicle toll collection system, a stationary control unit according to claim 1, wherein said logic means includes a first bi-stable means adapted to be set in response to the receipt of vehicle identification information signals, and second bi-stable means for being set in response to a vehicle present signal, and a coincidence AND gate for responding to said first bi-stable means being reset and said second bi-stable means being set for generating a stop signal indicating that a vehicle has failed to register its identity.

9. In a vehicle toll collection system, a stationary control unit according to claim 1, further including a mobile vehicle identification sending unit adapted to be carried individually on board the vehicles for sending a series of coded vehicle identification information signals uniquely identifying its vehicle, each one of said mobile control units including signal transmitting means for storing and for sending said series of coded vehicle identification information signals, signal receiving means for receiving one of said request signals from said stationary control unit, switching means responsive to said receiving means receiving said one of said request signals for causing said signal transmitting means to send its identification information signals, said switching means having means for de-energizing said transmitting means after said transmitting means completes sending its identification information signals.

10. In a vehicle toll collection system for vehicles, the system including at least one elongated vehicle lane indicia means for directing the vehicles therealong over a roadway, an arrangement comprising:

a mobile vehicle identification sending unit adapted to be mounted on at least one of the vehicles for sending a vehicle identification information signal;

a stationary control unit disposed at said indicia means for receiving said identification information from the vehicle equipped with the mobile unit as it passes thereby to register the vehicle identification for toll collection purposes;

vehicle detection means disposed at said indicia means for supplying a vehicle present signal to said control unit;

said control unit having means responsive to said vehicle present signal and a vehicle failing to send its vehicle identification information for generating a vehicle warning signal;

warning means being disposed at said indicia means and being responsive to said warning signal for indicating that a vehicle has not been registered;

said mobile unit including a bi-stable device adapted to be enabled for initiating the sending of the vehicle information signal, a signal generator having its input connected to the output of the bi-stable device generating said vehicle information signal;

wherein said information signal includes vehicle identification information including the state of registration of the vehicle and a request for a receipt, said mobile unit including means for resetting the bi-stable device after a given time delay interval sufficient to permit the sending of the information signal.

11. In a system for identifying vehicles moving along a vehicle lane, an arrangement comprising:

a stationary control unit being disposed at said lane and having receiving means adapted to receive a series of vehicle identification information signals from each one of a series of the vehicles traveling therepast along the vehicle lane, said signals being coded to identify uniquely the vehicle sending it;

memory means responsive to said receiving means receiving identification information signals from passing vehicles for storing the identification information signals;

indicating means for sending individual human-sensible signals immediately back to the vehicles passing by said stationary control unit to indicate whether or not the vehicles have properly registered their identity;

logic means responsive to said receiving means receiving all of the identification information signals from each one of the passing vehicles for controlling said indicating means for each one of the passing vehicles according to whether or not identification information signals were properly received;

a mobile vehicle identification sending unit adapted to be carried on board a vehicle; and said mobile unit including signal transmitting means for storing and for sending its vehicle identification information signals, switching means for causing said signal transmitting means to send its identification information signals, said switching means de-energizing said transmitting means after sending its identification information signals.

12. In a system, a mobile vehicle identification sending unit according to claim 11, wherein said switching means includes a manually operable normally open switch.

13. In a system, a mobile vehicle identification sending unit according to claim 11, wherein said system includes abutment means disposed in the vehicle lane, further including vehicle condition sensing switch for closing when the vehicle engages said abutment means.

14. In a system, a mobile vehicle identification sending unit according to claim 13, wherein said vehicle condition sensing switch comprises a shaker switch for closing in response to the vibration of the vehicle as it engages said abutment means.

15. In a system, a mobile vehicle identification sending unit according to claim 14, further including a normally open ON-OFF switch, and indicating means energizable when said switching means is energized.

16. In a vehicle toll collection system for vehicles, a mobile vehicle identification sending unit adapted to be carried on board a vehicle for communicating with a stationary control unit as the vehicle moves near it, comprising:

signal transmitting means for storing and for sending a series of coded vehicle identification information signals to the stationary control unit, said signals uniquely identifying the vehicle;

signal reveiving means for receiving a request signal from said stationary unit as the vehicle moves near it;

switching means responsive to said receiving means receiving said request signal for causing said signal transmitting means to send its identification information signals;

said switching means having means for de-energizing said transmitting means after said transmitting means completes sending its identification information signals; and said switching means including bi-stable means adapted to be enabled for initiating the sending of said vehicle information signals, said signal transmitting means having its input connected to the output of said bi-stable means for generating said vehicle information signals.

* * * * *